US006681024B2

(12) United States Patent
Klein et al.

(10) Patent No.: US 6,681,024 B2
(45) Date of Patent: Jan. 20, 2004

(54) DEVICE INCLUDING A BUILT-IN ELECTROACOUSTIC TRANSDUCER FOR OPTIMUM SPEECH REPRODUCTION

(75) Inventors: Erich Klein, Himberg (AT); Heinz Renner, Kaltenleutgeben (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 100 days.

(21) Appl. No.: 09/128,835

(22) Filed: Aug. 4, 1998

(65) Prior Publication Data

US 2001/0040975 A1 Nov. 15, 2001

(30) Foreign Application Priority Data

Aug. 5, 1997 (EP) ..... 97890155

(51) Int. Cl.[7] ..... H04R 25/00

(52) U.S. Cl. ..... 381/389; 181/199; 181/151; 181/171; 381/336; 381/374; 381/386; 381/365; 381/333; 381/301; 381/302; 381/86; 381/87

(58) Field of Search ..... 381/374, 385, 381/386, 387, 389, 365, 333, 303, 336, 104, 301, 388, 182, 351, 338; 181/151, 154, 171, 199, 141; 297/217.4, 397; 5/904

(56) References Cited

U.S. PATENT DOCUMENTS 3,944,020 A * 3/1976 Brown ..... 181/141
4,023,566 A * 5/1977 Martinmaas
4,027,112 A 5/1977 Heppner et al.
4,038,499 A * 7/1977 Yeaple
4,440,443 A * 4/1984 Nordskog
4,490,842 A * 12/1984 Watanabe ..... 381/86
4,507,816 A * 4/1985 Smith, Jr.
4,638,884 A * 1/1987 Lee
5,170,435 A * 12/1992 Rosen et al.
5,398,992 A * 3/1995 Daniels
5,687,246 A * 11/1997 Lancon
6,044,161 A * 3/2000 Lee

* cited by examiner

*Primary Examiner*—Curtis Kuntz
*Assistant Examiner*—Dionne Harvey
(74) *Attorney, Agent, or Firm*—Steven R. Biren

(57) ABSTRACT

A device (8) which includes an electroacoustic transducer (7) for the acoustic reproduction of sound signals to an ear (14) of a user (2) who assumes a user position at the device. The transducer is optimized for the acoustic reproduction of speech-signal sound waves and is equipped with arrangement means (25) for realizing a distinct directivity for the speech-signal sound waves emitted by the transducer. As a result of its directivity, the transducer directs the speech-signal sound waves which it emits preferentially to the ear of a user who is in the user posture.

27 Claims, 3 Drawing Sheets

DEVICE INCLUDING A BUILT-IN ELECTROACOUSTIC TRANSDUCER FOR OPTIMUM SPEECH REPRODUCTION

BACKGROUND OF INVENTION

1. Field of the Invention

The invention relates to a device, in which a user can assume a user posture and which comprises a carrier for carrying at least one electroacoustic transducer, this carrier being made of an acoustically dense material and extending comparatively close to at least one ear of a user who is in the user posture, this carrier having an electroacoustic transducer attached for acoustic reproduction of sound signals for the ear of the user who is in the user posture, this transducer comprising sound-generation means for generating and emitting sound waves.

2. Description of the Related Art

Such a device of the type defined in the opening paragraph is known from, for example, U.S. Pat. No. 4,027,112. The known device is a seat for a motor vehicle, this seat having a headrest for supporting the head of a user whose user posture is a sitting posture. The headrest is for the greater part, formed by a supporting body provided as the carrier and consisting of an acoustically dense material, this supporting body having two recesses which are each located adjacent a supporting zone for the head and which each accommodate an electroacoustic transducer. The two electroacoustic transducers are constructed for an optimum acoustic reproduction of stereo signals, i.e. essentially music signals. Due to their arrangement on the headrest the two electroacoustic transducers are directed with their front sides towards the head of a user who is in a sitting posture but, in order to achieve said optimum reproduction of stereo signals, both transducers radiate sound waves whose intensities are the same as far as possible over an as large as possible angular range. As a result of this, the sound waves radiated by the two transducers not only reach the ears of the user, who is in a sitting posture, and can consequently be heard by the user with a volume set and desired by the user, but can also be heard by other nearby persons, for example, next to or behind the user. Quite frequently, this is annoying to these nearby persons. Moreover, with respect to the known seat, it is to be noted that the transducers arranged in the known seat and intended for an optimum reproduction of stereo signals are not capable of satisfactorily reproducing pure speech-signal sound waves as occur, for example, during hands-free operation of a telecommunication device.

SUMMARY OF THE INVENTION

It is an object of the invention to preclude the aforementioned situation in a device of the type defined in the opening paragraph, in a simple and economical manner and to provide an improved device of the type defined in the opening paragraph. According to the invention, in order to achieve this object, a device of the type defined in the opening paragraph is characterized in that the transducer is constructed for an optimum acoustic reproduction of speech-signal sound waves and the transducer is equipped with additional means for realizing a distinct directivity for the speech-signal sound waves emitted by said transducer and, as a result of its directivity, the transducer directs the speech-signal sound waves which it emits preferentially to an ear of a user who is in the user posture.

By means of the measures in accordance with the invention, a device is obtained in a simple, cheap and easy to realize manner, on which a user can assume a user posture—such as a sitting posture or a reclining posture—and which guarantees a satisfactory acoustic reproduction of speech and which, in addition, as a result of the radiation of speech-signal sound waves with a high intensity in a very small angular range due to the distinct directivity, provides a particularly well-aimed radiation towards an ear of a user who has assumed a user posture, which has the advantage that a highly satisfactory sound reception is achieved for a user of a device in accordance with the invention without any undesirable sound radiation of speech-signal sound waves in the vicinity of the user, so that hardly any inconvenience is caused to a person near the user. The well-aimed radiation achieved as a result of the distinct directivity further makes it possible for the user of a device, in accordance with the invention to assure, for a reproduction volume setting he has chosen that overhearing by a person near the user is substantially impossible in the case of speech reproduction, which is for example, desirable when confidential information is communicated to the user during a telephone call made with the aid of the transducer accommodated in the product. In a transducer in accordance with the invention, it has proved to be advantageous if the transducer is optimized for the reproduction of speech signals in a frequency range between approximately 500 Hz and 5 kHz.

It is to be noted that from the document European Patent Application 0 368 291 A1 a device, i.e., a seat of a motor vehicle, is known in which an electroacoustic transducer is accommodated in the area of a headrest, this transducer being adapted or constructed particularly for an acoustically correct reproduction of speech-signal sound waves. However, in said known seat, the transducer accommodated in the seat, i.e., in the headrest of this seat, does not comprise additional means for realizing the distinct directivity for the speech-signal sound waves emitted by this transducer, so that this transducer radiates speech-signal sound waves with high intensity not only in a small angular range but in a comparatively large angular range, as a result of which, this known device does not have the advantages of the invention provided by a device in accordance with the invention.

In a device in accordance with the invention having the characteristic features distinct directivity as described above it has proved to be very advantageous if, in addition, the additional means comprises a baffle interposed between the transducer and the acoustic free space, the transducer being connected to the baffle in an acoustically imperforate manner, and the baffle having at least one sound port—which connects the front volume situated in front of the sound generation means to the acoustic free space—and at least one opening—which connects the back volume situated behind the sound generation means to the acoustic free space—the baffle delaying the speech-signal sound waves emitted into the free space via the back volume 31 and the at least one opening, with respect to the speech-signal sound waves emitted via the front volume and the at least one sound port, to different extents in different directions. Such an embodiment has proved to be particularly effective and functional in practical tests. A further advantage of such an embodiment of the invention is that the baffle used, in this embodiment can be used at the same time, for mechanically supporting the electroacoustic transducer.

In a device in accordance with the invention having the characteristic features of a baffle as described above the additional means for realizing a distinct directivity for the speech-signal sound waves emitted by the transducer may include, in addition to the baffle, a felt-material configuration which forms an acoustic delay element. However, in a device in accordance with the invention having these characteristic features, it has proved to be very advantageous if, in addition, the additional means comprises a foam-material configuration which constitutes an acoustic delay element, and the foam-material configuration is arranged in the area of the sound path of the speech-signal sound waves emitted into the acoustic free space via the back volume and the at least one opening, and partly encloses the transducer. Such a foam-material configuration has the advantage that by a suitable choice of the structure of the foam material which is used the influence of the propagation time of the speech-signal sound waves by means of the relevant foam material can be adapted very simply and effectively to different requirements and conditions. The choice of the structure of a foam material may concern, for example, the density of a foam material and/or the air permeability of a foam material.

In a device in accordance with the invention having the characteristic features of a foam-material configuration as described above, it has proved to be particularly advantageous if, in addition, the foam-material configuration extends at least up to the at least one opening in the baffle. In this way a higher effectiveness of the foam-material configuration can be achieved.

In a device in accordance with the invention having the characteristic features of the foam-material configuration extending at least up to the at least one opening in the baffle as described above, it has proved to be very advantageous if, in addition, of the foam-material configuration fills the space in the at least one opening up to the carrier. In this way it is achieved that the foam-material configuration is used for filling the space in the at least one opening up to the carrier of the device, which is particularly advantageous if the entire carrier, together with the electroacoustic transducer accommodated therein and the additional means, is covered or upholstered with a cover, for example, a fabric or the like.

In a device in accordance with the invention having the characteristic feature of a foam-material configuration it has further proved to be very advantageous if, in addition, the foam-material configuration is pot-shaped and is accommodated in a correspondingly pot-shaped recess in the carrier, and the transducer is mounted in the pot-shaped foam-material configuration. Such an embodiment is advantageous for simply assembling a transducer already connected to a baffle and a foam-material configuration so as to form an intermediate device, and for simply building this intermediate device into a device in accordance with the invention.

In a device in accordance with the invention having the characteristic feature of a form material configuration it has further proved to be very advantageous if, in addition, the foam-material configuration consists of a single foam-material part. This is advantageous in view of a particularly simple and low-cost construction.

In a device in accordance with the invention having the characteristic features of distinct directivity as defined above it has further proved to be very advantageous if, in addition, the additional means is constituted by a foam-material configuration which comprises at least two foam-material parts having different foam-material structures, and the foam-material parts at least circumferentially enclose the transducer in the area of its back volume and directly adjoin one another pairwise and each directly adjoin the acoustic free space. Such an embodiment is very advantageous because it is particularly simple from a constructional point of view.

In a device in accordance with the invention having the characteristic features a foam-material configuration of at least two foam-material parts, it has proved to be very advantageous if, in addition, one of the foam-material parts consists of an acoustically dense foam material. Such an embodiment has proved to be very favorable in practical tests.

In a device in accordance with the invention having the characteristic feature of a form-material configuration it has further proved to be very advantageous if, in addition, the foam-material configuration consists of open-pore and, if necessary, densified polyurethane. Such an embodiment has also proved to be very advantageous in practical tests.

However, in a device in accordance with the invention having the characteristic feature of form-material configuration it has also proved to be very advantageous if, in addition, the foam-material configuration consists of open-pore and, if necessary, densified polyethylene. Such an embodiment has also proved to be very advantageous in practical tests.

However, it is to be noted that a foam-material configuration can also consist of other materials than those mentioned hereinbefore.

In a device in accordance with the invention having the characteristic features of distinct directive as defined above it has furthermore proved to be very advantageous if, in addition, the device in constructed as a seat. The measures in accordance with the invention have proved to be very advantageous in such a device. It is to be noted that a device in accordance with the invention can be constructed not only as a seat but, for example, as a bed, sofa or couch.

In a device in accordance with the invention having the characteristic features of being designed as a seat it has also proved to be very advantageous if, in addition, the device is constructed as a seat for a motor vehicle. In the case of a device in accordance with the invention constructed as a seat for a motor vehicle, the measures in accordance with the invention are found to be particularly advantageous and attractive to many users.

In a device in accordance with the invention having the characteristic features of distinct directivity as defined above it has further proved to be very advantageous if, in addition, at least one pair of transducers is attached to the carrier, and each of these transducers is equipped with additional means for realizing a distinct directivity for the speech-signal sound waves emitted by said transducer and, as a result of their directivities, one transducer of each pair of transducers directs the speech-signal sound waves which it emits preferentially to one of the two ears of a user who is in the user posture and the other transducer directs the speech-signal sound waves which it emits preferentially to the other one of the two ears of this user. Providing for example, two transducers which each have a distinct directivity has the advantage of a gain in volume and, consequently, a particularly good acoustic speech-signal reception. If required, it is also possible to connect four transducers to the carrier of which each two transducers emit speech-signal sound waves to one ear of a user.

The afore-mentioned aspects as well as further aspects of the invention will be apparent from the embodiments described hereinafter by way of examples and will be elucidated on the basis of these embodiments.

BRIEF DESCRIPTION OF THE DRAWINGS

The invention will now be described in more detail with reference to some embodiments shown in the drawings and given by way of examples, but to which the invention is not limited, in which.

DESCRIPTION OF THE PREFERRED EMBODIMENTS

Figure 1:
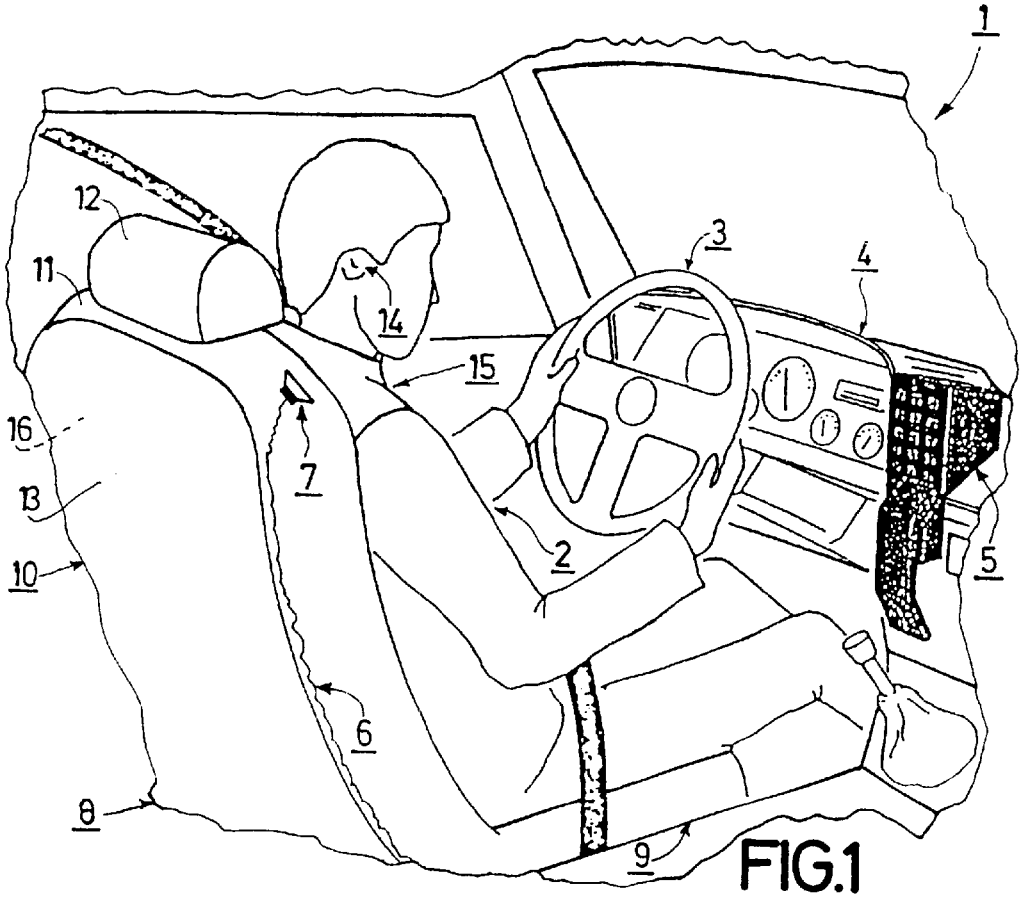
FIG. 1 shows, diagrammatically, a part of a motor vehicle with a driver's seat in accordance with a first embodiment of the invention, the seat having built-in electroacoustic transducer for emitting speech-signal sound waves, the transducer being shown only diagrammatically in FIG. 1.

FIG. 1 shows that part of a motor vehicle 1 which is relevant in the present context. In principle, only that part of the motor vehicle 1 is shown which is intended for the driver 2 of the motor vehicle 1, the driver being shown diagrammatically. This part includes a steering wheel 3 as well as a dashboard 4, which is equipped with, inter alia, a telephone set 5. The telephone set 5 is constructed for hands-free operation, in which mode of operation words spoken by the driver 2 are picked up by a microphone incorporated in the telephone set 5 and speech signals received by means of the telephone set 5 are applied to an electroacoustic transducer 7, shown diagrammatically, via an electrically conductive connection 6, which is shown only partly and diagrammatically. The electroacoustic transducer 7 is constructed as a loudspeaker.

The part of the motor vehicle 1 shown in FIG. 1 further includes a device in accordance with the invention, i.e., a seat 8 for the motor vehicle 1. The seat 8 essentially comprises a bottom part 9 and a back 10 whose upper part 11 carries a headrest 12.

A user of the seat 8, i.e., the driver 2, can assume a user posture on the seat 8, in the present case, a sitting posture, as is shown in FIG. 1.

Figure 2:
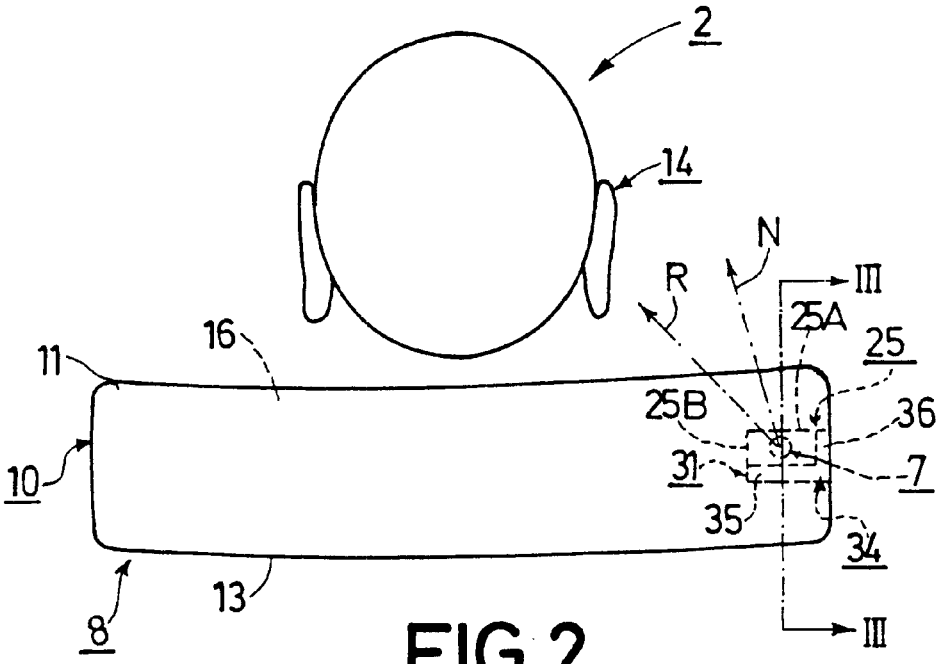
FIG. 2 shows a plan view of the upper part of the driver's seat of the motor vehicle of FIG. 1, including the built-in electroacoustic transducer, which is equipped with additional means for realizing a distinct directivity for the speech-signal sound waves emitted by this transducer, and also shows diagrammatically the head of a driver sitting on the driver's seat.
Figure 3:
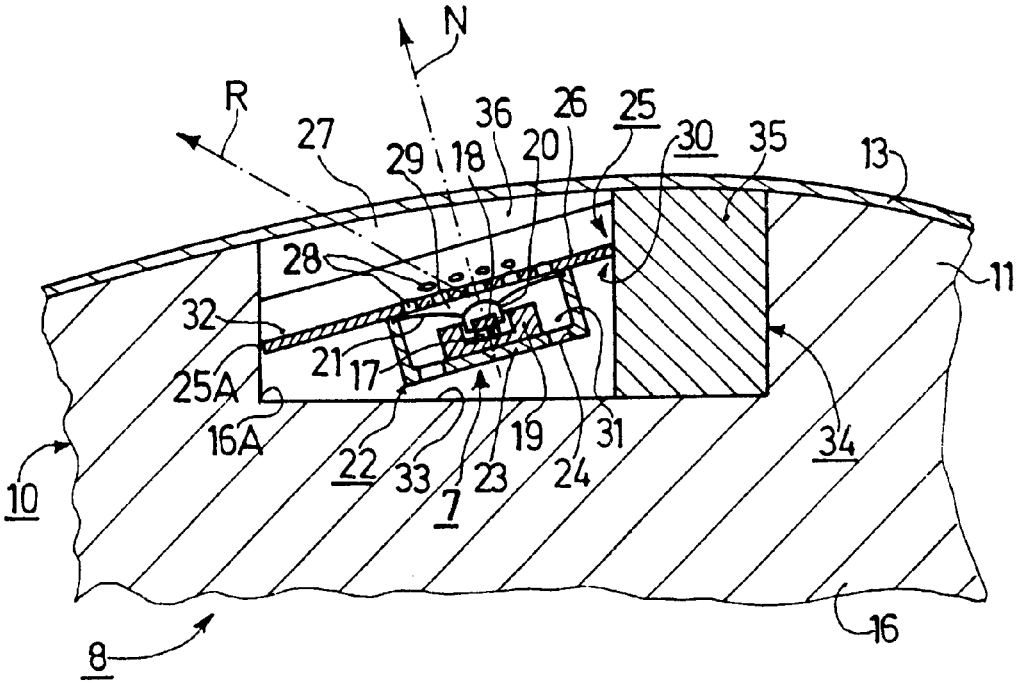
FIG. 3 shows the upper part of the driver's seat of the motor vehicle of FIG. 1, including the built-in electroacoustic transducer and the additional means for realizing a distinct directivity, in a cross-sectional view taken on the line III—III in FIG. 2.

The area of the upper part 11 of the seat 8 is also shown in FIGS. 2 and 3, but without the headrest 12. As is apparent from FIG. 3, the seat 8 may be upholstered with a cover 13 of a fabric or a similar material. To support the body of the driver 2, i.e., also to support at least a part of the body which is situated comparatively close to an ear—such as the shoulder area 15 near the right ear 14 of driver 2—of the driver 2 in the user posture, the seat 8 comprises a supporting body 16 of an acoustically dense material, this supporting body serving as a carrier for an electroacoustic transducer, and extending comparatively close to the ear 14 of the driver 2. The afore-mentioned electroacoustic transducer 7 is connected to a carrier formed by the support body 16 for acoustically reproducing sound signals for the ear 14 of the driver 2 in the user posture. The transducer 7 is attached to or built into the supporting body 16, for which purpose the supporting body 16 has a recess 16A which accommodates the transducer 7. The term "attached or built into" excludes the case where a transducer is attached to a head rest or the like, which in turn is attached to the support body.

The electroacoustic transducer 7 is shown diagrammatically but in greater detail in FIG. 3. The transducer 7 comprises a magnet 17 which adjoins a disc-shaped cover plate 18 at one side and a pot-shaped yoke 19 at the other side. Between the free end face of the pot-shaped yoke 19 and the cover plate 18, an annular air gap is formed, into which a moving coil 20 projects, which is mechanically attached to a diaphragm 21. The diaphragm 21 forms sound-generation means for generating and emitting sound waves, this means are disposed in the area of the transducer 7 which is remote from the supporting body 16. The diaphragm 21 is fixedly attached to a substantially pot-shaped housing 22 of the transducer 7 in the area of a free end face of the housing 22, for example, by means of an adhesive joint. The housing 22 also accommodates the pot-shaped yoke 19, the magnet 17 and the cover plate 18, these three parts 17, 18 and 19, which form the magnet system of the transducer 7, each being connected to one another and to the housing, respectively, by means of an adhesive joint. It is to be noted that in the area of its bottom wall 23, the housing 22 has a plurality of passages 24, which means that the housing is acoustically open towards the rear.

Advantageously, the transducer 7 in the seat 8 shown in FIGS. 1, 2 and 3, is constructed so as to achieve an optimum acoustic reproduction of speech-signal sound waves. In the transducer 7, this is achieved in a manner known per se by a suitable construction of its magnet system 17, 18 and 19, its moving coil 20, its diaphragm 21 and its housing 22. This construction of the transducer 7 guarantees a correct sound reproduction in a frequency range from approximately 500 Hz to approximately 5 kHz, which is particularly advantageous for an optimum acoustic reproduction of speech-signal sound waves.

The transducer 7 in the seat 8 further comprises additional means 25 for realizing a distinct directivity for the speech-signal sound waves which it emits and, as a result of its directivity, the transducer 7 directs the speech-signal sound waves which it emits preferentially to the right ear 14 of the driver 2 in the sitting posture.

In the present case the additional means 25 comprises a baffle 26 interposed between the transducer 7 and the acoustic free space. The acoustic free space bears the reference numeral 27 in FIG. 3. It is emphasized that the acoustic free space 27 is situated not only inside the recess 16A in the supporting body 16 but also outside the cover 13 for the supporting body 16. The baffle 26 is wholly accommodated in the recess 16A and has its long side wall 25A and its short side wall 25B connected to the respective side walls of the recess 16A, preferably during the forming process; however, such a connection can also be made by means of a kind of press-fit or by means of an adhesive joint. The transducer 7 is connected to the baffle 26 in an acoustically imperforate manner. In the present case, this is achieved in that the free end face of the pot-shaped housing 22 of the transducer 7 is connected to the baffle 26 by means of an adhesive.

The baffle 26 has a plurality of sound ports 28 which connect the front volume 29 of the transducer 7, which is situated in front of the diaphragm, to the acoustic free space 27. As is apparent from FIG. 3 and also from FIG. 2, the baffle 26 does not cover the whole cross-sectional area of the recess 16A in the supporting body 16 but the baffle 26 has a substantially L-shaped opening 30, which connects the back volume 31 of the transducer 7, this volume being situated behind the diaphragm 21, to the acoustic free space 27, this connection, in the present case, being made via the passages 24 in the bottom wall 23 of the pot-shaped housing 22 and via a part of the recess 16A in the supporting body 16. By means of the baffle 26, the speech-signal sound waves emitted into the free space 27 via the back volume 31, the passages 24 in the bottom wall 23 of the pot-shaped housing 22, a part of the recess 16A in the supporting body 16 and the opening 30, can be delayed to different extents in different directions. Thus, it is achieved in a manner known per se that speech-signal sound waves emitted by the diaphragm 21 via the back volume 31 and the opening 30 produce a comparatively strong attenuation of speech-signal sound waves emitted towards the opening 30 via the front volume 29, while the speech-signal sound waves emitted towards the imperforate area 32 of the baffle 26 via the front volume 29 cannot be attenuated by speech-signal sound waves propagating via the back volume 31 and the passages 24 because said area 32 is imperforate, as a result of which, speech-signal sound waves emitted towards the imperforate area 32 of the baffle 26 via the front volume 29 are transmitted substantially without attenuation. Thus, a distinct directivity for the speech-signal sound waves emitted by the transducer 7 is obtained by means of the baffle 26. As a result of this distinct directivity, the transducer 7 preferentially emits speech-signal sound waves to the right ear 14 of the driver 2 in the direction indicated by means of a dash-dot arrow R.

As regards the baffle 26, it is to be noted that the baffle 26 is arranged in an inclined position with respect to the bottom wall 33 of the recess 16A, the baffle 26 being inclined with respect to the bottom wall 33 in directions parallel to the plane of drawing in FIG. 3, as well as perpendicular to the plane of drawing, as a result of which, a normal to the plane, indicated by a dash-dot arrow N in FIGS. 2 and 3, is directed as shown in FIGS. 2 and 3.

In the seat 8, the additional means 25 for realizing a distinct directivity for the speech-signal sound waves emitted by the transducer 7 includes, in addition to the baffle 26, a foam-material configuration 34 which forms an acoustic delay element. In the present case, this foam-material configuration 34 is essentially L-shaped and comprises a portion 35, which, in FIG. 3, extends perpendicularly to the plane of section indicated by the line III—III in FIG. 2, and a portion 36, which extends substantially perpendicularly to the portion 35 and which projects laterally from the portion 36. In its area which is remote from the bottom wall 33 of the recess 16A, the two portions 35 and 36 are rounded in accordance with the curved shape of the supporting body 16 and the curved shape of the cover 13 around the supporting body 16.

The foam-material configuration 34 is arranged in the sound path of the speech-signal sound waves emitted to the acoustic free space 27 via the back volume 31, the passages 24 and the opening 30 and partly encloses the transducer 7 in conformity with its L shape. As is apparent from FIG. 3, the form-material configuration 34, in the present case, fills the opening 30 up to the supporting body 16. Advantageously, the foam-material configuration 34 consists of a single part of a foam material. In the present case the foam-material configuration consists of open-pore and, if necessary, densified polyurethane; however, it may alternatively consist of any other foam material. By means of the foam-material configuration 34 the speech-signal sound waves emitted into the acoustic free space 27 via the back volume 31, the passages 24 and the opening 30 can be influenced as regards their propagation time, which, in addition, enables the distinct directivity for the speech-signal sound waves emitted by the transducer 7 to be influenced in an advantageous manner.

As a result of the provision of the baffle 26 and the additional provision of the foam-material configuration 34 in the seat 8, it is achieved, in a very simple manner, that the transducer exhibits a distinct directivity for the speech-signal sound waves which it emits and that due to its directivity, the transducer emits the speech-signal sound waves preferentially to the right ear 14 of the driver 2, who is in the sitting posture.

Figure 4:
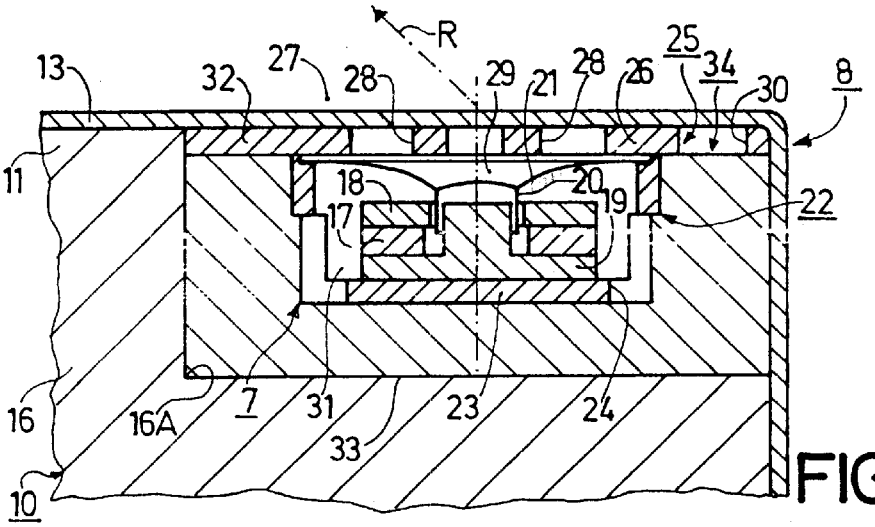
FIG. 4 is a sectional view taken along a plane of section substantially perpendicular to the plane of section taken on the line III—III in FIG. 2, and shows the upper part of a driver's seat in a second embodiment of the invention, including a built-in electroacoustic transducer equipped with additional means for realizing a distinct directivity for the speech-signal sound waves emitted by this transducer, FIG. 5, in the same way as FIG. 4, shows the upper part of a driver's seat in a third embodiment of the invention, including a built-in electroacoustic transducer equipped with additional means for realizing a distinct directivity for the speech-signal sound waves emitted by this transducer, FIG. 6, in the same way as FIGS. 4 and 5, shows the upper part of a driver's seat in a fourth embodiment of the invention, including a built-in electroacoustic transducer equipped with additional means for realizing a distinct directivity for the speech-signal sound waves emitted by this transducer.

FIG. 4 shows a seat 8 in accordance with a second embodiment of the invention. The supporting body 16 forming the carrier in this seat 8 also has a recess 16A which accommodates an electroacoustic transducer 7 comprising a magnet system 17, 18 and 19, a moving coil 20, a diaphragm 21 and a pot-shaped housing 22. The transducer 7, which is arranged in the seat 8 shown in FIG. 4 and which is constructed to provide a correct acoustic reproduction of speech-signal sound waves, also has additional means 25 for realizing a distinct directivity for the speech-signal sound waves emitted by the transducer 7. Here, these additional means 25 also comprise a baffle 26 and a foam-material configuration 34. In the present case, the baffle 26 has, in addition to the sound ports 28, some further passages forming openings 30, of which only a single opening 30 is visible in FIG. 4. In the present case, the foam-material configuration 34 extends up to the openings 30 in the baffle 26. The foam-material configuration 34 is now pot-shaped and is accommodated in a correspondingly pot-shaped recess 16A in the supporting body 16. The transducer 7 is mounted in the pot-shaped foam-material configuration 34. In the present case, the foam-material configuration 34 consists of open-pore and/or densified polyurethane, but may alternatively consist of other foam materials.

Figure 5:
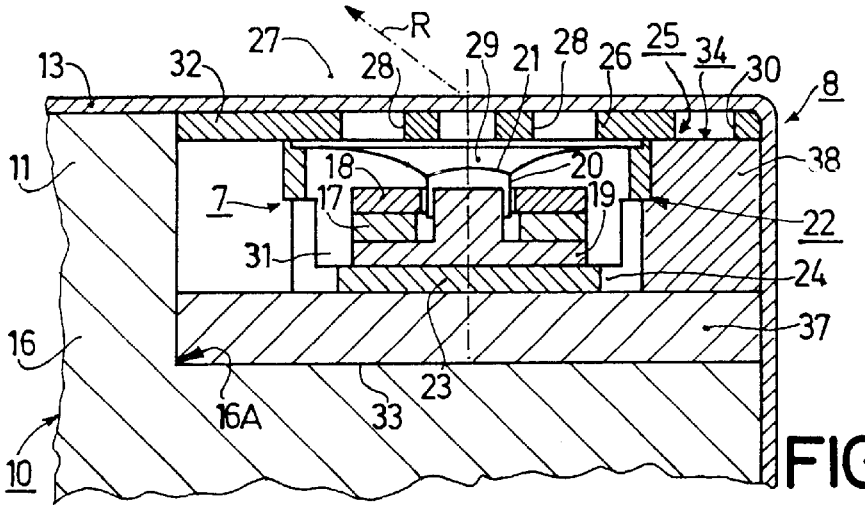

FIG. 5 shows a seat 8 in accordance with a third embodiment of the invention. The seat 8 in the present embodiment bears a strong resemblance to the seat 8 in FIG. 4, but an essential difference resides in the structure of the foam-material configurations 34 in the seats 8 of FIGS. 4 and 5.

Whereas the foam-material configuration 34 in the seat 8 of FIG. 4 comprises a single foam-material part, the foam-material configuration 34 in the seat 8 of FIG. 5 comprises two foam-material parts 37 and 38. One foam-material part 37 is disc-shaped, is disposed on the bottom wall 33 of the recess 16A, and supports the bottom wall 23 of the pot-shaped housing. The other foam-material part 38 has a semi-annular shape in such a manner that it borders on all the openings 30 in the baffle 26.

Figure 6:
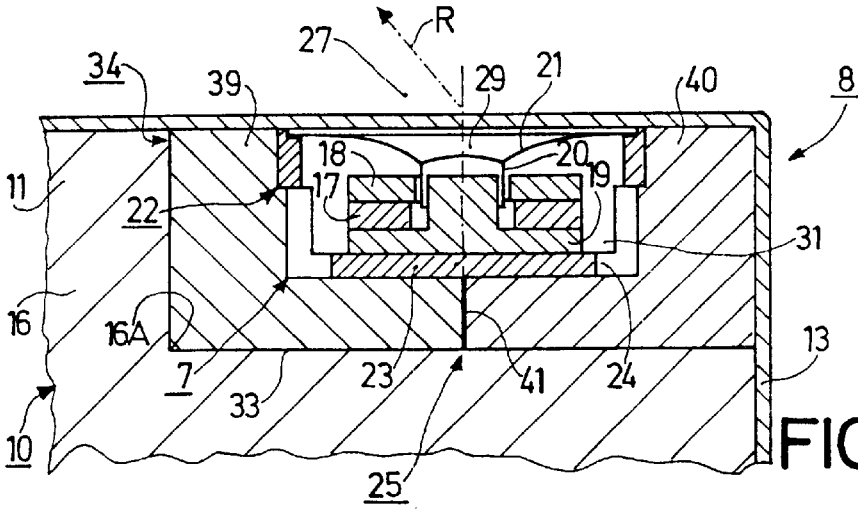

FIG. 6 shows a seat 8 in accordance with a fourth embodiment of the invention, which differs from the two seats 8 of FIGS. 4 and 5 in that in the present case, the additional means 25 of the transducer 7, which serve for realizing a distinct directivity for the speech-signal sound waves emitted by the transducer 7, does not comprise a baffle but, in a particularly simple manner, is formed by a foam-material configuration 34 comprising two foam-material parts having different foam material structures. The two foam-material parts 39 and 40 each have the shape of a half pot, in such a manner that, in conformity with their shape, they enclose the transducer 7 in the area of its back volume 31 both circumferentially and at the bottom side. The two foam-material parts 39 and 40 adjoin one another directly at the location of a separating zone 41. Furthermore, the free end face of the semi-annular portion corresponding to the half-pot shape of each of the two foam-material parts 39 and 40 directly adjoins the acoustic free space 27, where said end faces are shrouded by the cover 13. In the seat 8 of FIG. 6, the one foam-material part 39 consists of an acoustically dense foam material and the other foam-material part 40 consists of an acoustically permeable foam material. This choice of the foam material for the two foam-material parts 39 and 40 results in a distinct directivity for the speech-signal sound waves emitted by the transducer 7, so that the transducer 7 preferentially emits speech-signal sound waves to an ear of a user of the seat 8 in the direction indicated by means of a dash-dot arrow R.

Figure 7:
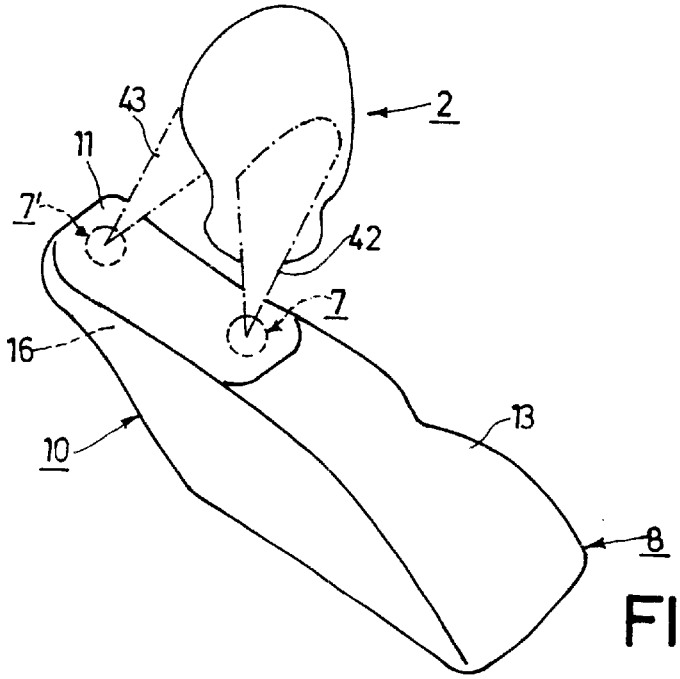
FIG. 7 shows diagrammatically the back of a seat of a motor vehicle in a fifth embodiment of the invention, the seat having two built-in electroacoustic transducers.

FIG. 7 diagrammatically shows the back 10 of a seat 8 in accordance with a fifth embodiment of the invention. In this seat 8 the supporting body 16 forming the carrier carries a pair of electroacoustic transducers 7 and 7' for the optimum reproduction of speech-signal sound waves, each of these two transducers 7 and 7' being provided, in a manner not shown, with additional means for realizing a distinct directivity for the speech-signal sound waves which they emit. Each of the two transducers 7 and 7', as a result of the directivity, preferentially emit speech-signal sound waves to one of the two ears of a user of the seat 8, who is in a sitting posture, as is indicated diagrammatically by means of two dash-dotted sound-emission cones 42 and 43 in FIG. 7.

The invention is not limited to the embodiments described hereinbefore by way of examples. For example, a foam-material configuration may comprise more than two foam-material parts. In alternatives to the embodiments shown in FIGS. 4 and 5, a baffle may be provided, which may be inclined with respect to the bottom wall of the recess in at least one direction—preferably also in two directions. Instead of in the upper part of the back of a seat, an electroacoustic transducer together with its additional means for realizing a distinct directivity can be mounted in a headrest attached to the back of the seat. Furthermore, it is to be noted that an electroacoustic transducer together with its additional means for realizing a distinct directivity need not necessarily be built into a seat but can also be accommodated in a unit arranged on the outside of a seat, this unit also being constructed as an add-on unit, which has the advantage that the advantages of the invention can also be obtained for existing seats or similar devices. A device in accordance with the invention need not necessarily be constructed as a seat but can also be constructed as a couch, a patient chair or a patient couch. Moreover, the measures in accordance with the invention can also be applied to aircraft or train seats. Finally, a device in accordance with the invention need not necessarily be constructed as a seat, patient chair, couch or the like, but can also be constituted by the roof or the roof area of a motor vehicle or by an overhead service unit for passengers in an aircraft.

What is claimed is:

1. A device in which a user can assume a user posture, said device comprising:

at least one electroacoustic transducer; and a carrier for carrying said at least one electroacoustic transducer and for supporting an upper torso portion of said user, said carrier being made of an acoustically dense material and extending comparatively close to at least one ear of a user who is in the user posture, said at least one electroacoustic transducer being attached to the carrier adjacent the portion thereof which supports the upper torso for acoustic reproduction of sound signals for the ear of the user who is in the user posture, said at least one electroacoustic transducer comprising sound-generation means for generating and emitting sound waves, characterized in that the transducer is constructed for an optimum acoustic reproduction of speech-signal sound waves, additional means for realizing a distinct directivity for the speech-signal sound waves emitted by said at least one electroacoustic transducer, whereby, as a result of said distinct directivity, the speech-signal sound waves emitted from said at least one electroacoustic transducer are directed preferentially to the ear of the user who is in the user posture, and the additional, means comprises a baffle interposed between the at least one electroacoustic transducer and an acoustic free space, the at least one electroacoustic transducer being connected to the baffle in an acoustically imperforate manner, said baffle having at least one sound port for connecting a front volume, situated in front of the sound generation means, to the acoustic free space, and at least one opening for connecting a back volume, situated behind the sound generation means, to the acoustic free space, whereby the baffle delays the speech-signal sound waves emitted into the acoustic free space via the back volume and the at least one opening, with respect to the speech-signal sound waves emitted via the front volume and the at least one sound port, to different extents in different directions.

2. A device as claimed in claim 1, characterized in that, in addition to the baffle, the additional means comprises a foam-material configuration which constitutes an acoustic delay element, the foam-material configuration being arranged in the area of a sound path of the speech-signal sound waves emitted into the acoustic free space via the back volume and the at least one opening, and partly encloses the at least one electroacoustic transducer.

3. A device as claimed in claim 2, characterized in that the foam-material configuration extends at least up to the at least one opening in the baffle.

4. A device as claimed in claim 3, characterized in that the foam-material configuration tills a space in the at least one opening in the battle up to the carrier.

5. A device as claimed in claim 2, characterized in that the foam-material configuration is pot-shaped and is accommodated in a correspondingly pot-shaped recess in the carrier, and the at least one electroacoustic transducer is mounted in the pot-shaped foam-material configuration.

6. A device as claimed in claim 3, characterized in that the foam-material configuration includes a single foam-material part.

7. A device as claimed in claim 2, characterized in that the foam-material configuration comprises open-pore and densified polyurethane.

8. A device as claimed in claim 2, characterized in that the foam-material configuration comprises open-pore and densified polyethylene.

9. A device in which a user can assume a user posture, said device comprising:

at least one electroacoustic transducer; and a carrier for carrying said at least one electroacoustic transducer and for supporting an upper torso portion of said user, said carrier being made of an acoustically dense material and extending comparatively close to at least one ear of a user who is in the user posture, said at least one electroacoustic transducer being attached to the carrier for acoustic reproduction of sound signals for the ear of the user who is in the user posture, said at least one electroacoustic transducer comprising sound-generation means for generating and emitting sound waves, characterized in that the transducer is constructed for an optimum acoustic reproduction of speech-signal sound waves, additional means for realizing a distinct directivity for the speech-signal sound waves emitted by said at least one electroacoustic transducer, whereby, as a result of said distinct directivity, the speech-signal sound waves emitted from said at least one electroacoustic transducer are directed preferentially into an anterior acoustic free space and directly to the ambient air in the direction of the ear of the user who is in the user posture, characterized in that the additional means comprises a foam-material configuration including at least two foam-material parts having different foam-material structures and operative as an acoustic delay element and being arranged in a sound path of sound waves emitted into the acoustic free space via the back volume of the electroacoustic transducer, the foam-material parts at least circumferentially enclosing the at least one electroacoustic transducer in the area of the back volume, said at least two foam-material parts directly adjoining one another pairwise and each of said at least two foam-material parts directly adjoining an acoustic free space anterior of the electroacoustic transducer.

10. A device as claimed in claim 9, characterized in that one of the at least two foam-material parts comprises an acoustically dense foam material.

11. A directional loudspeaker apparatus comprising:

an electroacoustic transducer for generating and emitting sound waves, a carrier made of an acoustically dense material and having a recess therein in which the electroacoustic transducer is attached, the recess in said carrier being located in a portion thereof separate from any headrest if present for a user of the loudspeaker apparatus, such that the electroacoustic transducer can emit sound waves to the ear of the user of the loudspeaker apparatus, and additional means for realizing a distinct directivity for the sound waves emitted by said electroacoustic transducer, whereby, as a result of said distinct directivity, the sound waves emitted from said electroacoustic transducer are directed preferentially to the ear of the user along a linear path from the electroacoustic transducer to the ear of the user and wherein the additional means comprises a form-material body operative as an acoustic delay element and being arranged in a sound path of the sound waves emitted into the acoustics free spaced via the back volume of the electroacoustic transducer.

12. The loudspeaker apparatus as claimed in claim 11 wherein the electroacoustic transducer is arranged to generate and emit only speech-signal sound waves.

13. The loudspeaker apparatus as claimed in claim 11 wherein said carrier comprises a seat for the user of the loudspeaker apparatus, and the recess is located in the back-rest portion of the seat.

14. The loudspeaker apparatus as claimed in claim 11 wherein the additional means comprises a foam-material acoustic delay body including at least first and second foam-material acoustic delay parts having different foam-material structures, the foam-material parts at least circumferentially enclosing the electroacoustic transducer in the area of the back volume so as to realize the distinct directivity for the sound waves.

15. The loudspeaker apparatus as claimed in claim 14 wherein the first foam-material part comprises an acoustically dense foam-material and the second foam-material part comprises an acoustically permeable foam-material.

16. The loudspeaker apparatus as claimed in claim 11 wherein said electroacoustic transducer has a housing that is acoustically open at its rear surface and the additional means further comprises a foam-material body operative as an acoustic delay element and which at least partly encloses the electroacoustic transducer, the foam material body being arranged in a sound path of the sound waves emitted into the acoustic free space via the acoustically open rear surface of the transducer.

17. The loudspeaker apparatus as claimed in claim 11 wherein the electroacoustic transducer is arranged in the carrier recess so as to emit the sound waves via an anterior acoustic free space and directly into the ambient air in a direction that will linearly intersect the ear of the user of the loudspeaker apparatus.

18. The loudspeaker apparatus as claimed in claim 11 wherein the additional means comprises a foam-material body operative as an acoustic delay element and being arranged in a Sound path of the sound waves emitted into the acoustic free space via the back volume of the electroacoustic transducer, and the foam material body includes at least first and second foam material acoustic delay parts having different foam material structures, the foam material parts at least circumferentially enclosing the electroacoustic transducer in the area of the back volume so as to realize the distinct directivity for the sound waves.

19. A directional loudspeaker apparatus, comprising:

an electroacoustic transducer for generating and emitting sound waves, a carrier made of an acoustically dense material and having a recess therein in which the electroacoustic transducer is attached, the recess in said carrier being located in a portion thereof separate from any headrest if present for a user of the loudspeaker apparatus, such that the electroacoustic transducer can emit sound waves to the ear of the user of the loudspeaker apparatus, and additional means for realizing a distinct directivity for the sound waves emitted by said electroacoustic transducer, whereby, as a result of said distinct directivity, the sound waves emitted from said electroacoustic transducer are directed preferentially to the ear of the user along a linear path from the electroacoustic transducer to the ear of the user, and wherein the additional means comprises a battle interposed between the electroacoustic transducer and an acoustic free space and with the electroacoustic transducer connected to the baffle in an acoustically imperforate manner, said baffle having at least one sound port for coupling a front volume of the electroacoustic transducer to the acoustic free space and at least one opening for coupling a back volume thereof to the acoustic free space, whereby the baffle delays the sounds waves emitted into the acoustic tree space via the back volume and the at least one opening with respect to the sound waves emitted via the front volume and the at least one sound port.

20. The loudspeaker apparatus as claimed in claim 19 wherein the additional means further comprises a foam-material body operative as an acoustic delay element and which at least partly encloses the electroacoustic transducer, the foam material body being arranged in a sound path of the sound waves emitted into the acoustic free space via the back volume and the at least one opening.

21. The loudspeaker apparatus as claimed in claim 20 wherein the foam material body extends at least up to the at least one opening in the baffle.

22. The loudspeaker apparatus as claimed in claim 20 wherein the carrier recess is pot-shaped and the foam-material body has a corresponding pot-shape, and the electroacoustic transducer is mounted in the pot-shaped foam-material body.

23. The loudspeaker apparatus as claimed in claim 20 wherein the foam-material body comprises an open pore material.

24. The loudspeaker apparatus as claimed in claim 19 wherein the electroacoustic transducer is arranged in the carrier recess so as to emit the sound waves through the at least one sound port of the baffle in a direction that will linearly intersect the ear of the user of the loudspeaker apparatus.

25. The loudspeaker apparatus as claimed in claim 20 wherein the carrier recess is pot-shaped and the foam-material body is in two parts, wherein the first part is disc-shaped and is disposed in a bottom wall of the carrier recess, and supports a bottom wall of the electroacoustic, transducer, and the second part has a semi-annular shape and it borders on said at least one opening in the baffle.

26. A directional loud speaker apparatus comprising: an electroacoustical transducer for generating and emitting sound waves, a carrier made of an acoustically dense material and having a recess therein in which the electroacoustic transducer is attached, the recess in said carrier being located in a portion thereof separate from any headrest if present for a user of the loudspeaker apparatus, such that the electroacoustic transducer can emit sound waves to the ear of the user of the loudspeaker apparatus, and additional means for realizing distinct directivity for the sound waves emitted by the electroacoustic transducer, whereby as a result of said directivity, the sound waves emitted from said electroacoustic transducer are directed preferentially to the ear of the user along a linear path from the electroacoustic transducer to the ear of the user, and wherein the additional means comprises a baffle interposed between the electroacoustic transducer and an acoustic free space and with the electroacoustic transducer connected to the baffle, said baffle having at least one sound port for coupling a front volume of the electroacoustic transducer directly to the acoustic free space along said linear path from the electroacoustic transducer to the ear of the user, and at least one port for coupling a back volume situated behind the electroacoustic transducer, to the acoustic free space.

27. The loudspeaker apparatus as claimed in claim 26 wherein the additional means further comprises a foam material body operative as an acoustic delay element and which at least partly encloses the electroacoutic transducer, the foam material body being arranged in a sound path of the Sound waves emitted into the acoustic tree space via the back volume of the electroacoustic transducer.

* * * * *